US012391509B2

(12) United States Patent
Zechner

(10) Patent No.: US 12,391,509 B2
(45) Date of Patent: Aug. 19, 2025

(54) FOLDING MACHINE FOR PAPER AND SOFT FOLDING MATERIAL

(71) Applicant: Karl Zechner, Mariazell (AT)

(72) Inventor: Karl Zechner, Mariazell (AT)

( * ) Notice: Subject to any disclaimer, the term of this patent is extended or adjusted under 35 U.S.C. 154(b) by 2 days.

(21) Appl. No.: 18/563,103

(22) PCT Filed: May 10, 2022

(86) PCT No.: PCT/AT2022/060163
§ 371 (c)(1),
(2) Date: Nov. 21, 2023

(87) PCT Pub. No.: WO2022/246486
PCT Pub. Date: Dec. 1, 2022

(65) Prior Publication Data

US 2024/0270534 A1 Aug. 15, 2024

(30) Foreign Application Priority Data

May 25, 2021 (AT) ..... A 50408/2021

(51) Int. Cl.
*B65H 45/14* (2006.01)
*B65H 35/06* (2006.01)
*B65H 45/18* (2006.01)

(52) U.S. Cl.
CPC ..... *B65H 45/14* (2013.01); *B65H 35/06* (2013.01); *B65H 45/18* (2013.01); *B65H 2404/1421* (2013.01); *B65H 2701/1924* (2013.01)

(58) Field of Classification Search
CPC ..... B65H 35/06; B65H 45/14; B65H 45/16; B65H 45/18; B65H 45/161; B65H 2404/1421; B65H 2701/1924
(Continued)

(56) References Cited

U.S. PATENT DOCUMENTS 4,218,052 A * 8/1980 Noren ..... B65H 45/161 493/425
5,803,890 A * 9/1998 Zechner ..... B43M 3/04 493/419
2008/0108492 A1* 5/2008 Zechner ..... B65H 45/14 493/419

FOREIGN PATENT DOCUMENTS

EP 0436102 A1 7/1991
EP 2279684 A2 2/2011
(Continued)

*Primary Examiner* — Leslie A Nicholson, III
(74) *Attorney, Agent, or Firm* — NGUYEN TARBET IP LAW

(57) ABSTRACT

The invention relates to a folding machine for paper and soft folding material, comprising a supporting frame (1), in which a rotary bearing (2) is rotatably mounted, the rotary bearing containing mutually parallel rotatable working rolls (17, 18, 19), wherein: a pressing device (6) for pressing the paper (39) onto positions of the rotary bearing (2) is provided, and an outer control element (7) which is rotated conjointly with the rotary bearing is provided: the pressing device (6) is mounted in an opening flap (26) and is formed by two profiled elements (28, 36), which are controlled by the outer control element (7); the first profiled element (28) receives and transports the paper (39) in cooperation with a first working roll (17), and the second profiled element (36) leads the paper (39), in contact with a first working roll (17) and a third working roll (19) running oppositely to each other, to a folding gap (44); and a pivoting nose (20), which is rotated conjointly with the rotary bearing (2) and is positively controlled by means of an inner control element (11), is provided for a second folding of the paper (39) in a second folding gap (45) between the first working roll (17) and the second working roll (18).

15 Claims, 6 Drawing Sheets

(58) Field of Classification Search
USPC ..... 270/32
See application file for complete search history.

(56) References Cited

FOREIGN PATENT DOCUMENTS

| | | | |
|---|---|---|---|
| WO | WO9408882 | A1 | 4/1994 |
| WO | WO2006048177 | A2 | 5/2006 |

* cited by examiner

FOLDING MACHINE FOR PAPER AND SOFT FOLDING MATERIAL

The invention relates to a folding machine for paper and soft folding material with a bearing frame in which a rotary bearing is rotatably mounted, which contains mutually parallel rotatable working rolls, wherein a press-on device for pressing the paper against positions of the rotary bearing and an external control element rotated with the rotary bearing are provided.

Hygiene paper, such as toilet paper or kitchen paper, is preferably used as soft folding material. Such folding machines for folding paper and soft folding material also serve as hygiene paper dispensers when they make the folded sheet of folding material available for removal after the folding process.

The invention is based on a prior art according to WO 2006/048177 A2 as well as WO 94/08882 and EP 2279684A2, to which reference is hereby made. In this known buckle folding machine, four working rolls with the same outside diameter are arranged together in a revolving rotary frame mounted in a machine frame. A pair of conveyor rolls, which are also mounted in the machine frame, is controllable via a link of the rotary frame and interacts with it when the folding material is fed in and compressed to form the first fold. To draw in, fold and eject the paper, the rotary frame is set in rotation by a drive, whereby one of the rolls revolving with it is displaceable by means of a cam and forms the second fold together with another working roll.

The known buckle folding machine is controlled by the revolving rotary frame and its link as well as by the internal cam or, in the case of a fully electronic control system, also by the rotational speed ratio between the working rolls and the rotary frame. The paper is fed in, folded and ejected while the rotary frame is revolving. However, soft materials cannot be folded smoothly with the compression function.

One object of the present invention is to design the known folding machine for soft folding material—predominantly hygiene papers—as a variant without a compression function and to enable the feeding of the paper without an upstream feed technology and the paper feed without a separate drive unit. A further object was to additionally integrate an automatic detection system for the length of a paper sheet section and a separation function for perforated and non-perforated hygiene paper.

The present invention is characterised, inter alia, in that the press-on device is mounted in an opening flap and is formed by two profile bodies which are controlled by the external control element, and wherein the first profile body receives and transports the paper in interaction with a first working roll and the second profile body feeds the paper in contact with the first working roll and the third working roll running in opposite directions to a first folding nip and wherein a pivoting lug, which rotates with the rotary bearing and is positively controlled via an internal control element, is provided for a second folding of the paper in a second folding nip between the first working roll and the second working roll.

In the invention, instead of a pair of conveyor rolls interacting with adjacent working rolls and guided along the side discs of a rotary frame designed as a control curve, a press-on device is arranged movably via a pivot axis running parallel to the rotary bearing and transversely to the paper feed direction, which, in interaction with the adjacent working rolls, causes the paper to be received and transported as well as its first fold and supports the separation of the hygiene paper.

Furthermore, the first profile body may advantageously be provided with a contact surface or alternatively with a transport roll and the second profile body with a round spout, wherein at least one lateral link roller is provided on each of the two profile bodies, which runs on a bearing axis positioned parallel to the pivot axis of the press-on device for engagement with an external control element.

Furthermore, it may be provided in the invention that a rotary bearing has two side discs rotatable about a bearing axis and connected to one another via a web, at least one of the side discs being designed with a control curve rotated with it as an external control element which controls the pivoting of the profile bodies.

A further feature is that the two profile bodies of the press-on device perform pivoting movements against a spring force and along the side discs of the rotary bearing, which are designed as a control curve. For this purpose, the control curve is divided into curve sections that control the receiving and transport of the paper as well as the first fold and the separation of the paper.

The pivoting movement of the first profile body is restricted for its control, wherein a locking surface of the second profile body limits the outward movement and a locking surface of the opening flap guides the first profile body separately from the control curve to receive the paper on the first working roll and bridges lower set curve sections.

The present invention further shows that in the rotary bearing, instead of a displaceable working or compression roll, there is arranged a pivoting lug which is pivotably mounted over a longitudinal axis extending parallel to the working rolls, preferably about the axis of the third working roll, and which is spring-biased towards the paper and which, with its lug-shaped design, is positively controlled pivotable via an internal control element into a position for free advance and into a position for direct feeding of the soft, prefolded paper into the second folding nip formed by a pair of working rolls without compression function, wherein the control element is formed by a control cam rotatably positioned on the bearing plate for engaging a lateral link roller, which runs on a bearing shaft positioned parallel to the longitudinal axis of the pivoting lug.

The outward-facing side of the pivoting lug may be designed as an unwinding surface for the transport roll of the first profile body for feeding the paper.

The position of the internal control element and the gear ratio between the revolution of the rotary bearing and that of the working rolls determine the length of the second sheet section.

For folding hygiene paper into different lengths and folding types, the invention may provide an electronic control of the drive shaft of the rotary bearing and the working rolls, which can take place both via the speed ratio and via a stop/start function, wherein the paper is received during the revolution of the rotary bearing, folded primarily into three layers, separated, the length of a sheet section determined and provided from the bearing frame. The length of the paper feed through the first profile body in contact with the first working roll until the paper is fed through the round spout of the second profile body into the first folding nip of the working rolls of the revolving rotary bearing forms the length of the first sheet and the folding type.

A sensor is preferably positioned in the transport channel which, after activation of the paper dispenser, detects the leading edge of the inserted paper during the feed and controls the further feed up to the first fold according to the length input of a sheet section required for the respective sheet unit.

The length of a sheet section of a sheet unit can also be determined automatically by the sensor detecting both the leading edge of the first sheet after new paper has been inserted during the feed and the end of the last section after the folds have been made and separated, so that the determined length of the individual sheet sections can be used to control further sheet units.

Since the paper, which is fed forward after insertion, already passes through all work steps before the automatically determined value, the path from the separation position to the second folding position is equal to or greater than the maximum required length of a sheet section and a reference value is defined for the control system in order to obtain a usable result for the application even with a first run.

For folding paper to a predetermined length and folding type, a mechanical control with a fixed gear can be provided between the revolution of the rotary bearing and that of the working rolls, wherein the corresponding gear ratio is formed from the insertion length of the paper during loading—which during operation corresponds to the length of the sheet that is ready for the next paper receiving station after separation in the transport channel—further from the path of the unwinding surface of the pivoting lug and the feed length of the paper through the first working roll until it is received in the first folding nip.

An opening flap movable on a longitudinal axis running transversely to the paper feed direction is arranged in the bearing frame, in which the press-on device is movably mounted via a pivot axis running parallel to the longitudinal axis of the opening flap, wherein the opening flap can be folded away from the rotary bearing for the insertion of new paper and the transport channel can be opened. Once the paper has been inserted, the opening flap is closed and locked in place.

To separate perforated paper with programmable sheet length or automatic sheet length detection and control via a variable speed ratio between the drive pulley and the working rolls, in a further embodiment the second profile body is provided with profile fingers which, together with the profile body, perform a rocking movement towards the second working roll caused by the control curve and generate a selective counter-tension to the transport direction in the paper running between them, which leads to separation.

Furthermore, a separating web may be provided which covers the second working roll and is arranged parallel to it, the guide surface of which preferably has a structural shape which can engage in the perforation of the paper and which, in interaction with the press-on device, forms a separating device for folded, perforated paper, wherein the profile bodies, which are moved via a control curve of the side disc and are limited in their movement by locking surfaces, jointly cause a counter-tension which supports the separation by their braking effect during the transport of the paper over the separating web.

For separating folded, non-perforated paper, a separating device with a separating web, preferably without a structure of the guide surface, and with a toothed folding blade, which can be opened on a bearing axis parallel to the working rolls and against the paper feed direction and is aligned over the entire width of a sheet, are provided in the rotary bearing according to a further embodiment of the invention, which, in interaction with the second profile body of the press-on device during the revolution of the rotary bearing at a defined curve section of the control curve of a side disc and against a spring force (not shown), is brought from a closed position into a position for separating the paper.

Further advantageous features of the invention can be found in the description, the claims and the drawings. In the following, the invention is described in more detail with reference to exemplary embodiments and the drawings.

Figure 6:
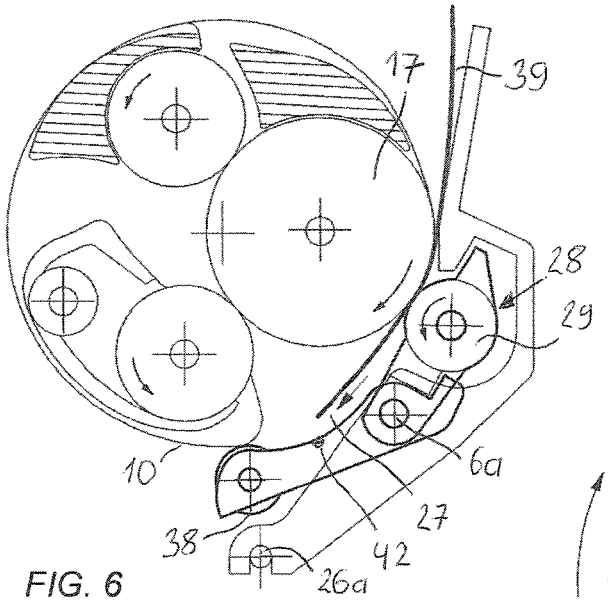

FIG. 6 schematically shows the paper being received by the rotary bearing and transported further in the transport channel.

Figure 7:
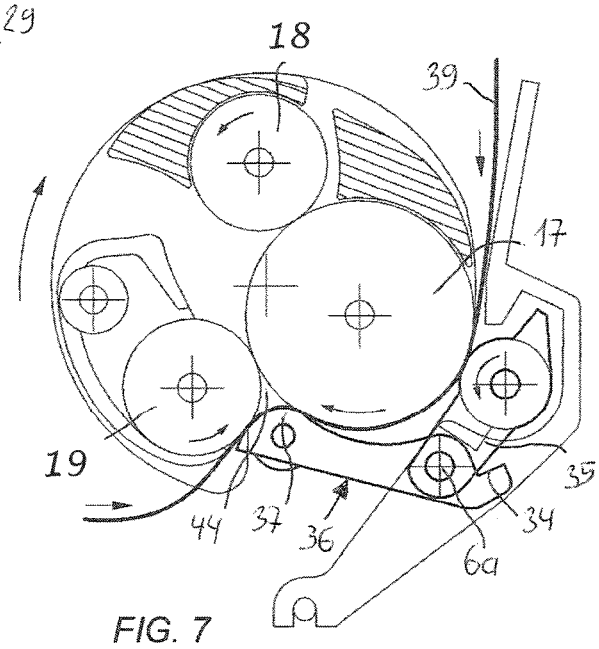

FIG. 7 shows the feeding of the paper until it is fed into the first folding nip.

Figure 8:
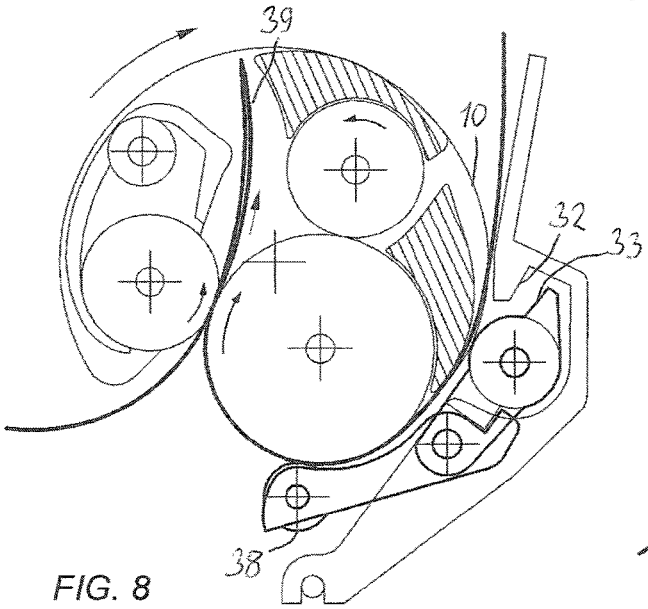

FIG. 8 schematically shows the further transport of the paper through the rotary bearing after the first folding.

Figure 9:
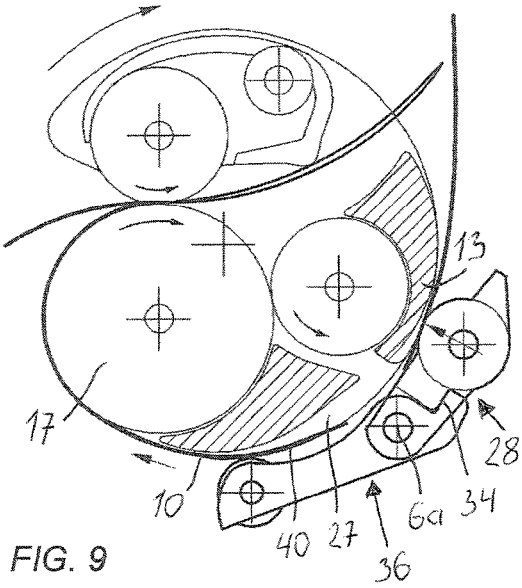

FIG. 9 schematically shows a separation of a perforated paper during the revolution of the rotary bearing.

Figure 10:
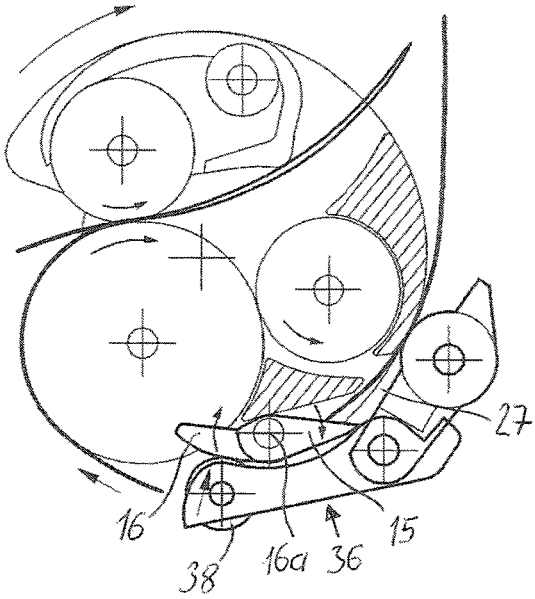

FIG. 10 schematically shows a separation of a non-perforated paper by a folding blade revolving with the rotary bearing.

Figure 11:
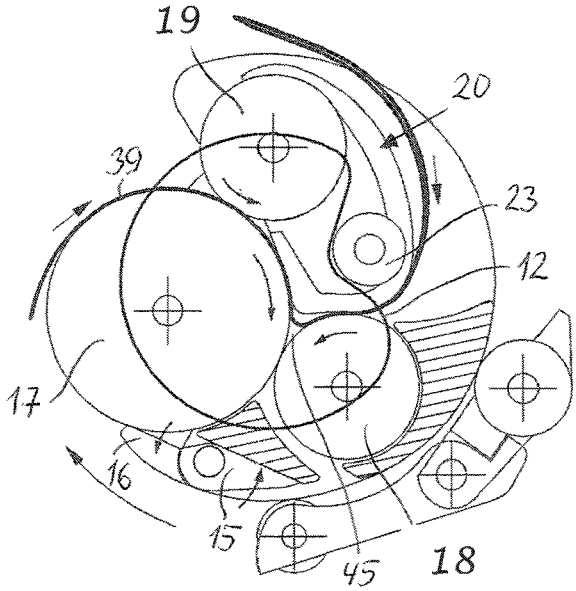

FIG. 11 shows the second folding process with the paper being fed by the pivoting lug into the second folding nip.

Figure 12:
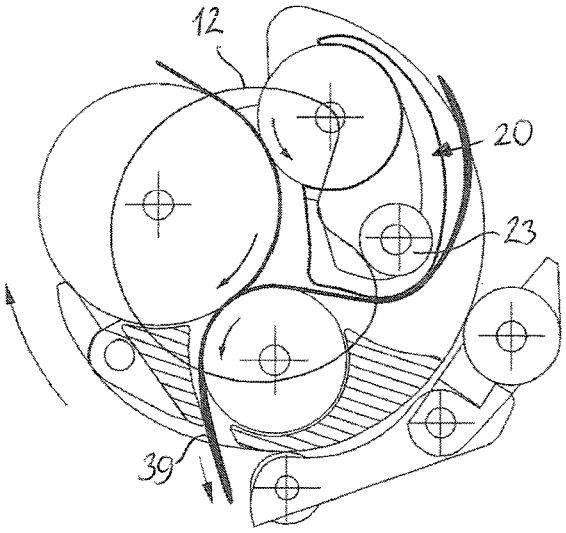

FIG. 12 shows the further transport of the paper after the second folding through the rotary bearing until it is ready for provision.

Figure 13:
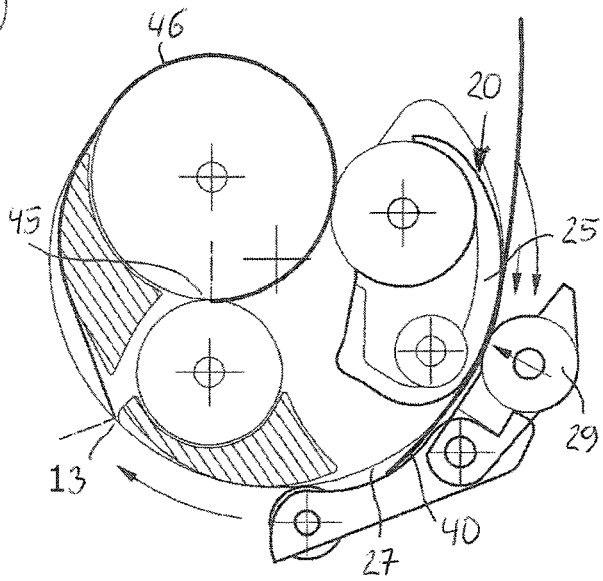

FIG. 13 schematically shows the transport of the paper remaining in the transport channel after separation in interaction with the pivoting lug as well as a path as a guide value for the design.

Figure 14:
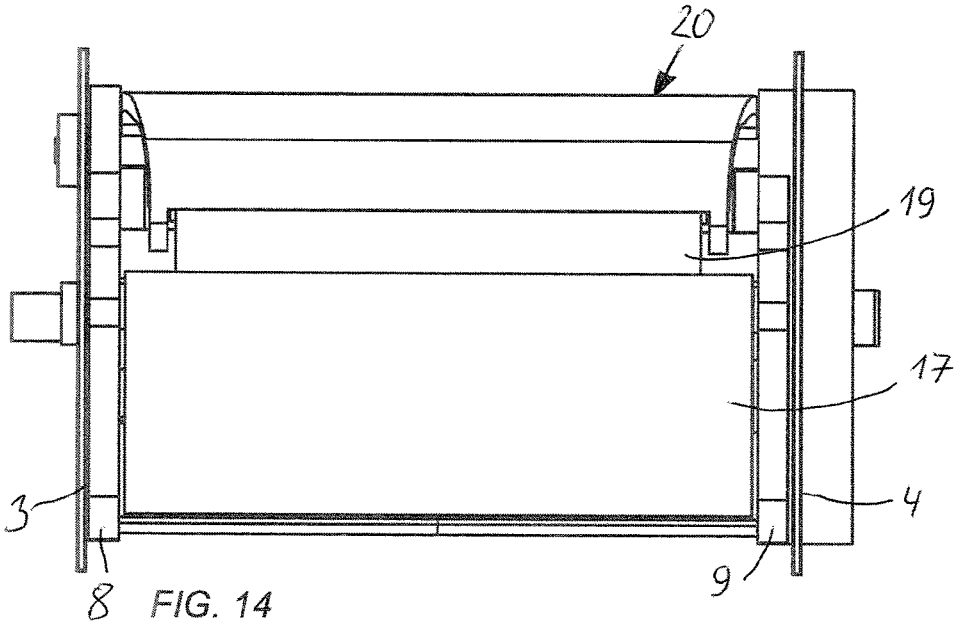

FIG. 14 shows the front view of the folding machine with pivoting lug and second working roll.

Figure 15:
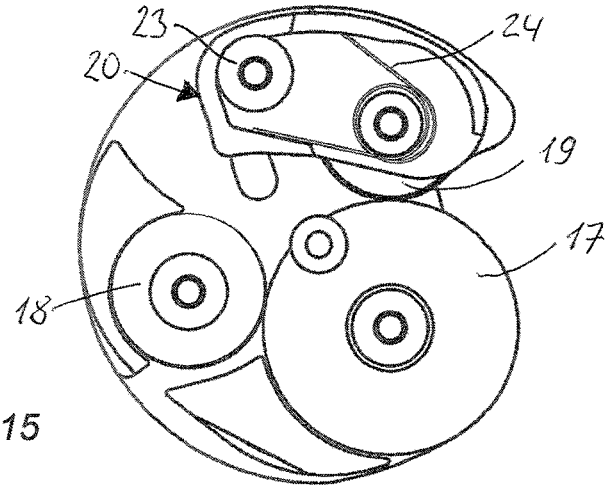

FIG. 15 shows the view of the inside of the folding machine with the side disc removed.

Figure 16:
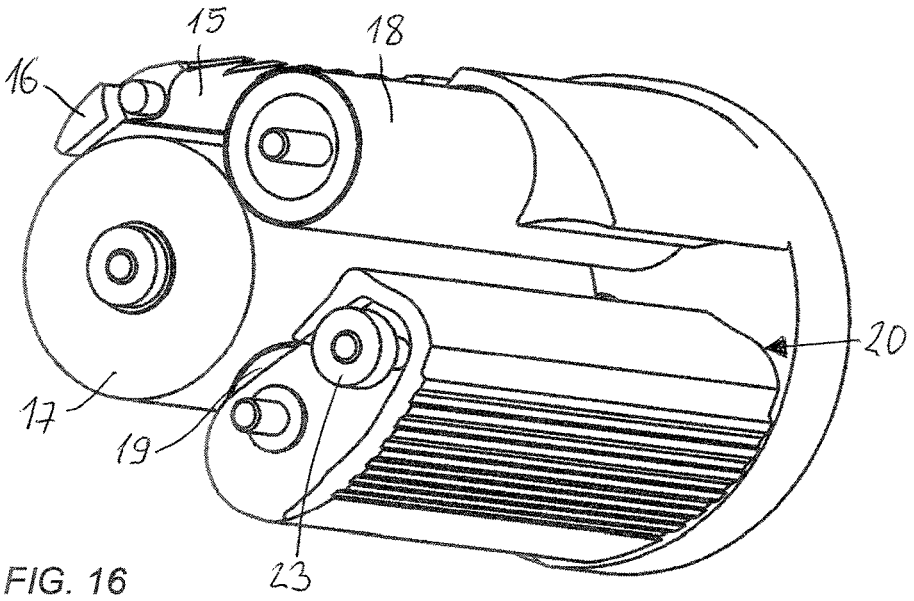

FIG. 16 shows a view of the inside with the side disc and opening flap removed.

Figure 17:
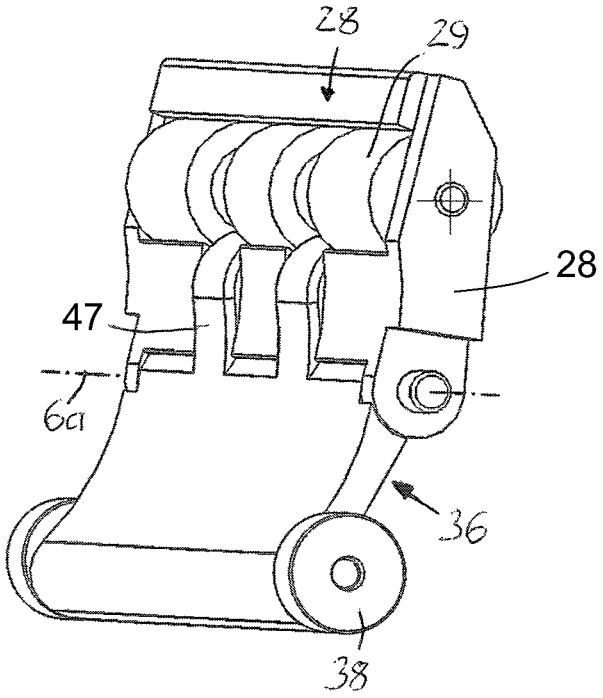

FIG. 17 shows a view of the inside of a modified version of the two profile bodies of the press-on device.

Figure 18:
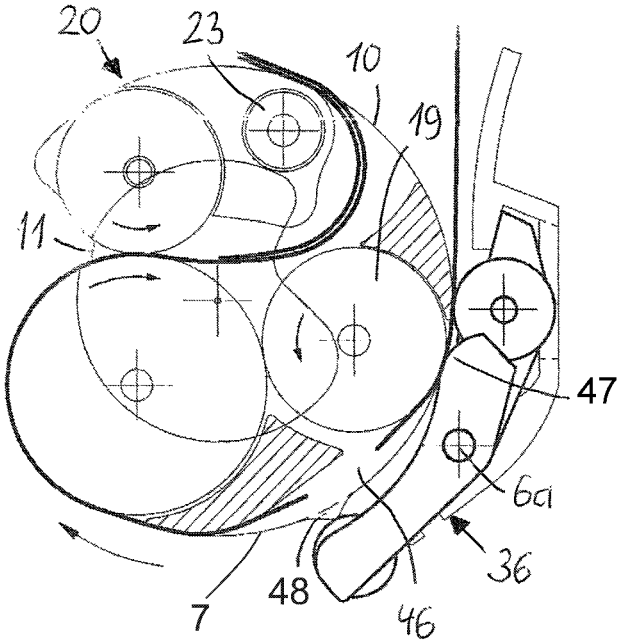

FIG. 18 shows a position of the press-on device with the variant according to FIG. 17, wherein the already partially folded sheet of paper is separated from the newly fed sheet of paper.

FIGS. 6 to 13 and 18 show the respective positions of the rotation bearing, the press-on device and the pivoting lug.

Figure 1:
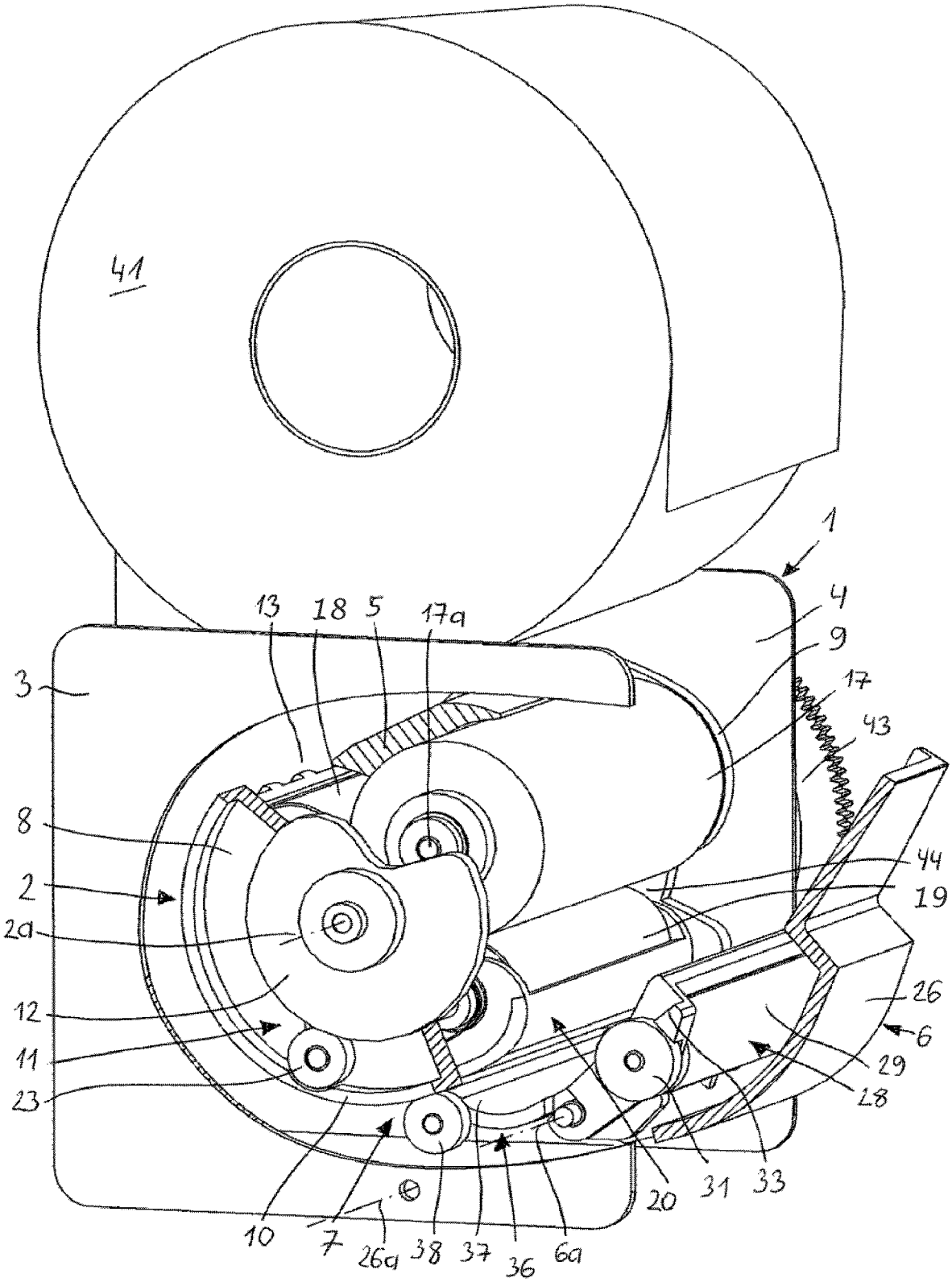
FIG. 1 shows a partial perspective view of the invention in an apparatus embodiment with the opening flap folded open.

FIG. 1 shows a perspective view of the folding machine in the form of a barrier-free toilet paper dispenser with a stationary bearing frame 1 in which a rotary bearing 2 is rotatably mounted via a bearing axis 2*a* in lateral bearing plates 3, 4 and is driven via a drive pulley 43, wherein the rotary bearing 2 contains three working rolls 17, 18, 19 parallel to each other, which interact with the pivoting lug 20 also mounted in the rotary bearing 2, a press-on device 6 movably mounted in an opening flap 26, a further external control element 7 and an internal control element 11 with the control cam 12 and a link roller 23 when receiving, transporting, detecting the sheet length, folding, separating and providing paper 39. The working rolls 17, 18, 19 are provided with bearing shafts 17*a*, 18*a*, 19*a* at their two end faces, which are rotatably mounted in the side discs 8, 9 of the rotary bearing 2. The bearing plate 3 is shown in a cutaway view.

The press-on device 6, shown in an open position, comprises a first profile body 28 and a second profile body 36 for interacting with the working rolls 17, 18, 19 of the rotary bearing 2. The press-on device 6 is movably mounted in an opening flap 26 via the pivot axis AV 6*a* and is positively displaced against the spring pressure of opposing compression springs (not shown) via the lateral link rollers 31, 38 of the profile bodies 28, 36, which are guided on the control curve 10 acting as an external control element 7 and moved on the bearing axes 31 *a* and 38*a*.

The transport roll 29 of the first profile body 28 transports the paper 39 in the transport channel 27 in interaction with the first working roll 17, wherein the round spout 37 of the second profile body 36 guides the paper 39 to the first folding nip 44. The paper 39 is pulled off the paper roll 41 above the folding machine.

Figure 2:
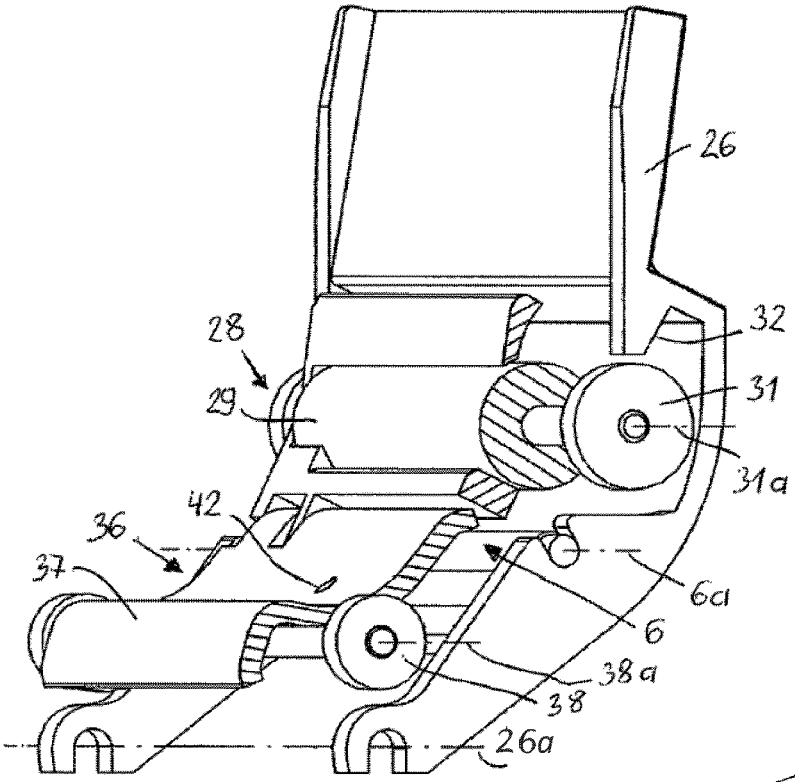
FIG. 2 shows a partial perspective view of the press-on device with both profile bodies.

FIG. 2 shows a side of the press-on device 6 facing the rotary bearing 2 with the opening flap 26, via the pivot axis 26*a* of which the opening flap 26 can be released together with the press-on device 6 for inserting and refilling the paper 39, and also a sensor 42 for detecting an inserted paper 39. The press-on device 6 has a transport roll 29 as the first profile body 28.

Figure 3:
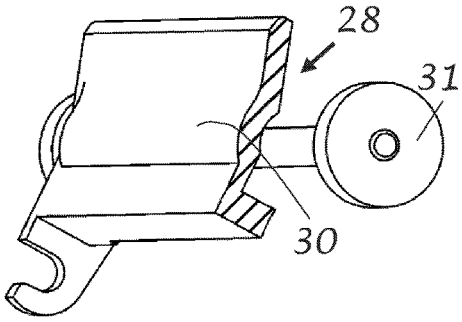
FIG. 3 shows a further embodiment of the first profile body of the press-on device.
Figure 5:
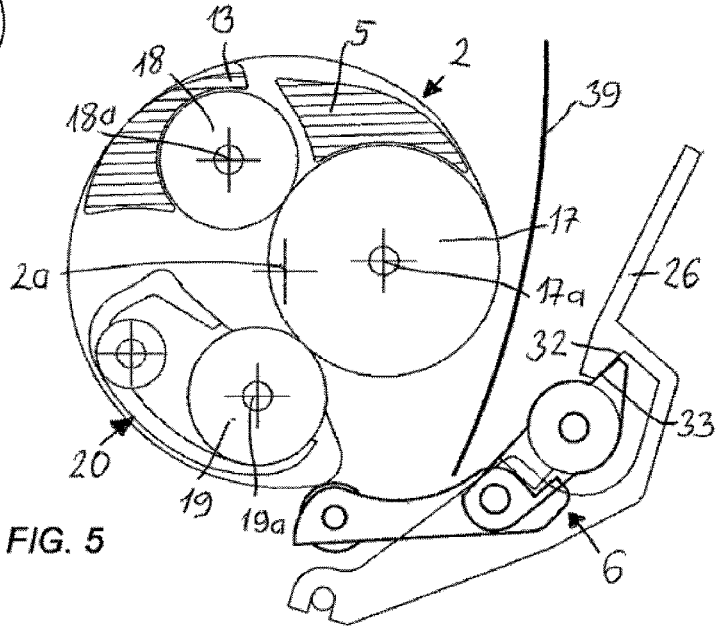
FIG. 5 shows a vertical side section view of a device for receiving, folding, separating and sheet length determining in an open position with a paper lying in the receiving position.

FIG. 3 shows a first profile body 28 with a contact surface 30 alternative to the transport roll 29. The parts of the press-on device 6 and their function are described below.

Figure 4:
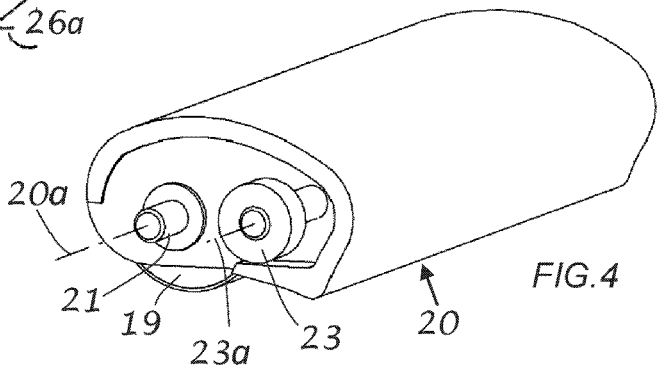
FIG. 4 shows a perspective view of the folding spout.

The pivoting lug 20 shown in FIG. 4 is formed from a lug-shaped element with two lateral bearing pins 21, 22 and a parallel, lateral link roller 23 moving on a bearing axis 23*a*. The pivoting lug 20 is arranged in the rotary bearing 2 (see FIGS. 5 to 13) in such a way that it is radially movable on an axis 20*a* running parallel to the working rolls 17, 18, 19 via lateral bearing pins 21 or via a bearing axis of a third working roll 19 and is pivotable against the spring pressure of form springs 24 via an internal control element 11 (see FIGS. 1 and 11 to 13).

FIGS. 1 and 5 to 9 show a separating web 13 arranged in the rotary bearing 2 between the side discs 8, 9 parallel to the bearing axis 2*a* and interacting with the guide web 5 for separating perforated paper 39, and FIGS. 10 to 13 show one with the separating web 14 and with the folding blade 15 for separating non-perforated paper 39.

FIGS. 10 to 13 show a folding process as a further embodiment based on the version of a fixed gear.

FIGS. 5 to 13 show the successive positions of the rotary bearing 2 of the folding machine during a 360° folding process and the respective positions of the pivoting lug 20 and the profile bodies 28, 36 when inserting, receiving, transporting, folding and providing the paper 39 using the example of a wrap fold. In this example, after the opening flap 26 is closed, the inserted paper 39 is received in interaction with the first working roll 17 and the first profile body 28 with its transport roll 29 and transported further in the transport channel 27 in the bearing frame 1 (see FIGS. 5 and 6). With an open opening flap 26, the first profile body 28 is limited in its movement towards the rotary bearing 2 by the locking surface 32 of the opening flap 26 in the same way as with a closed opening flap 26 for bridging lower set curve sections of the control curve 10 (see FIG. 5).

After the leading edge of the paper 39 is detected by the sensor 42 and the resulting precisely defined paper feed, the revolution of the rotary bearing 2 starts. The arrows in FIGS. 6 to 13 show the direction of rotation of the working rolls 17, 18, 19 of the transport roll 29 and the rotary bearing 2 as well as the transport direction of the paper 39.

To prevent compression when folding soft material, the direction of rotation of the rotary bearing 2 corresponds to the transport direction of the paper 39 in the transport channel 27. The transport roll 29 of the first profile body 28 transports the paper 39 in the transport channel 27 after contactless passage of the third working roll 19 and in interaction with the first working roll 17, where the round spout 37 of the trailing second profile body 36 guides the paper 39 to the first folding nip 44.

As shown in FIG. 7, the constant transmission ratio between the working rolls 17, 18, 19 and the rotary bearing 2 during further rotation of the rotary bearing 2 causes the paper 39 to be fed through the second profile body 36 and its round spout 37 precisely to that point in the rotary bearing 2, which guides the paper 39 directly to the first folding nip 44 through the contact of the round spout 37 with the working rolls 17, 19 (see FIG. 7).

With the first folded edge on the front side, the paper 39 continues to advance in the revolving rotary bearing 2 (see FIG. 8).

In the version in which the paper 39 is separated via a perforation, the first profile body 28, when rolling over the separating web 13, interacts with the second profile body 36 and its locking surface 34 and, by means of the pivot axis AV 6*a* and a defined section of the control curve 10, causes a counter-tension in the paper feed.

The paper 39 guided and tensioned over the separating web 13 during transport is separated by the external structure of the separating web 13 at the perforation of the last sheet and transported onwards. The paper 39 remaining in the transport channel 27 after the separation process is picked up during the next revolution of the rotary bearing 2 in interaction with the first working roll 17 and the first profile body 28 and pulled off the paper roll 41 for further transport (see FIGS. 6, 9, 10, 13, 18).

In the version of a separation of perforated paper 39 with variable sheet length, the second profile body 36 is moved over the pivot axis 6*a* to the second working roll 18 via a rocking movement caused by a cam 48 of a control curve 10, wherein the profile fingers 47 of the second profile body 36 with the working roll 18 generate a punctual counter-tension in the paper 39 running between them and separate it in the area of the freely guided separation path 46 (see FIG. 18).

In the version of separation by a blade, the second profile body 36 moves the spring-mounted, toothed folding blade 15 via a lever 16 and via the bearing axis 16*a* into the transport channel 27 during the revolution of the rotary bearing 2 in a predetermined position (see FIG. 10).

As the rotary bearing 2 continues to rotate, the pivoting lug 20 is brought in engagement of its lateral link roller 23 with a predetermined position on the control cam 12 and, as a result of the constant transmission ratio and against the force of a form spring (24), precisely to the position in which the paper 39 is guided into the second folding nip 45 for receiving by a pair of working rolls 17, 18 (see FIG. 11).

In the further advance, the pivoting lug 20 is returned to the starting position via the control cam 12 and the paper 39 with the second folded edge on the front side is guided out of the rotary bearing 2 and the bearing frame 1 and provided (see FIG. 12).

In operation with a fixed gear, before the joint receiving by means of the first working roll 17 and the first profile body 28, the paper 39 remaining in the transport channel 27 after separation is guided further into the transport channel 27 by the pressure of the transport roll 29 from the first profile body 28 against a higher transport surface 25 of the pivoting lug 20 as part of the first sheet section 40 during the revolution of the rotary bearing 2 (see FIG. 13).

The path 46 from the separating web 13 to the second folding nip 45 defines the maximum length of a sheet section 40 (see FIG. 13).

FIG. 14 shows a top view of the folding machine and FIG. 15 a side view with the side disc 8 removed and also shows the arrangement of the form spring 24 for positioning the pivoting lug 20.

FIG. 16 shows an oblique view with the side disc 8 removed and shows the arrangement of the folding blade 15 and its lever 16.

FIG. 17 shows an embodiment of a profile body 31 with two profile fingers 47.

FIG. 18 schematically shows the separation of perforated paper 39 with variable sheet lengths, whereby the press-on device 6 is pivoted by the cam 48 of the control curve 10 and the profile fingers 47 briefly hold the paper sheet.

By way of explanation, it is also indicated that the speed ratio of the drive pulley 43 (FIG. 1) driven by a 1st motor and the working rolls driven by a 2nd motor can determine the length of the separated sheets of paper 39. If a fixed gear is provided, positive control can be performed by a motor.

In FIGS. 9 and 13, the radial arrow drawn in the transport roll 29 indicates the clamping function for blocking the paper feed for tearing off the perforated paper 39. FIG. 10 shows the separation process by cutting of the folding blades 15 when non-perforated paper 39 is used.

LIST OF REFERENCE NUMBERS

1 Bearing frame
2 Rotary bearing
2*a* Bearing axis RL
3 Bearing plate
4 Bearing plate
5 Guide web
6 Press-on device
6*a* Pivot axis AV
7 External control element
8 Side disc
9 Side disc
10 Control curve
11 Internal control element
12 Control cam
13 Separating web with structure
14 Separating web without structure
15 Folding blade
16 Lever
16*a* Bearing axis KL
17 First working roll
17*a* Bearing shaft
18 Second working roll
18*a* Bearing shaft
19 Third working roll
19*a* Bearing shaft
20 Pivoting lug
20*a* Axis
21 Bearing pin
22 Bearing pin
23 Link roller
23*a* Bearing axis LR
24 Form spring
25 Transport surface
26 Opening flap
26*a* Pivot axis opening flap
27 Transport channel
28 First profile body
29 Transport roll
30 Contact surface
31 Link roller
31*a* Bearing axis LR
32 Locking surface
33 Abutting surface
34 Locking surface
35 Abutting surface
36 Second profile body
37 Round spout
38 Link roller
38*a* Bearing axis LR
39 Paper
40 Sheet section
41 Paper roll
42 Sensor
43 Drive pulley
44 First folding nip
45 Second folding nip
46 Path
47 Profile finger
48 Cam

The invention claimed is:

1. A folding machine for paper and soft folding material with a bearing frame (1), in which a rotary bearing (2) is rotatably mounted, wherein the rotary bearing includes a first working roll 17, a second working roll 18, and a third working roll 19 that are mutually parallel and rotatable, wherein a press-on device (6) for pressing the paper (39) against positions of the rotary bearing (2) and an external control element (7), which is rotated together therewith, are provided, characterised in that the press-on device (6) is mounted in an opening flap (26) and is formed by two profile bodies (28, 36) which are controlled by the external control element (7), wherein the first profile body (28) receives and transports the paper (39) in interaction with the first working roll (17), and the second profile body (36) guides the paper (39) in contact with the first working roll (17) and the third working roll (19) running in opposite directions to a first folding nip (44) for a first folding of the paper (39), and, wherein in that a pivoting lug (20), which rotates with the rotary bearing (2) and is positively controlled via an internal control element (11), is provided for a second folding of the paper (39) in a second folding nip (45) between the first working roll (17) and the second working roll (18).

2. The folding machine according to claim 1, characterised in that by means of the opening flap (26), the press-on device (6) can be folded away for the insertion of new paper (39) and a transport channel (27) can be opened.

3. The folding machine according to claim 1, characterised in that the first profile body (28) with a transport roll (29) or alternatively with a contact surface (30) and the second profile body (36) with a round spout (37) are spring-pivotable in the direction of the paper (39) and the rotary bearing (2).

4. The folding machine according to claim 1, characterised in that the pivoting lug (20) is pivotably mounted about a longitudinal axis running parallel to the working rolls, preferably about a bearing shaft (19*a*) of the third working roll (19), and is spring-biased in a disengaged position and is pivotable into the folding position via a control cam (12)

of the internal control element (11) when the rotary bearing (2) is rotated, the pre-folded paper (39) being guided by the pivoting lug (20) into the second folding nip (45) between the first and second working rolls (17, 18).

5. The folding machine according to claim 1, characterised in that the external control element (7) is a control curve (10) which rotates with the rotary bearing (2) and controls the pivoting of the profile bodies (28, 36).

6. The folding machine according to claim 1, characterised in that the rotary bearing (2) has two side discs (8, 9) rotatable about a bearing axis (2*a*) and in that at least one of the side discs (8, 9) is designed with a control curve (10) as the external control element (7).

7. The folding machine according to claim 6, characterised in that a guide web (5) is provided between the side discs (8, 9) for guiding the paper (39) in interaction with the separation of the paper (39) and for guiding the folded paper (39) to be provided.

8. The folding machine according to claim 6, characterised in that a separating web (13), preferably provided with an external structure, is arranged between the side discs (8, 9) for separating a folded, perforated paper (39).

9. The folding machine according to claim 6, characterised in that a toothed folding blade (15) interacting with a separating web (14) and pivotable via a lever (16) is arranged between the side discs (8, 9) for separating a folded, non-perforated paper (39).

10. The folding machine according to claim 1, characterised in that the opening flap (26) is formed with at least one locking surface (32) and the second profile body (36) is formed with at least one locking surface (34).

11. The folding machine according to claim 1, characterised in that the first profile body (28) is formed with two abutting surfaces (33, 35) for interaction with locking surfaces (32, 34).

12. The folding machine according to claim 1, characterised in that the two profile bodies (28, 36) together with the rotary bearing (2) in the bearing frame (1) form a transport channel (27) for the feed of the paper (39).

13. The folding machine according to claim 1, characterised in that a sensor (42) for detecting the paper (39) is arranged in the second profile body (36).

14. The folding machine according to claim 1, characterised in that an outwardly directed side of the pivoting lug (20) has a gripping structure for entraining the paper (39) in interaction with a transport roll (29).

15. The folding machine according to claim 1, characterised in that the second profile body (36) is formed with a profile finger (47) for separating folded, perforated paper (39) selectively designed with variable sheet lengths.

* * * * *